US006230422B1

(12) United States Patent
Sairanen

(10) Patent No.: US 6,230,422 B1
(45) Date of Patent: May 15, 2001

(54) METHOD AND APPARATUS FOR HANDLING AND DRYING A PULP WEB

(75) Inventor: Paavo Sairanen, Turku (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/463,448

(22) PCT Filed: Aug. 17, 1998

(86) PCT No.: PCT/FI98/00631

§ 371 Date: Jan. 27, 2000

§ 102(e) Date: Jan. 27, 2000

(87) PCT Pub. No.: WO99/09246

PCT Pub. Date: Feb. 25, 1999

(30) Foreign Application Priority Data

Aug. 18, 1997 (FI) ..... 973377

(51) Int. Cl.[7] ..... F26B 7/00

(52) U.S. Cl. ..... 34/422; 34/444; 34/448; 34/114; 34/117; 34/638; 34/647; 34/657; 162/207

(58) Field of Search ..... 34/111, 116, 117, 34/119, 120, 124, 147, 647, 638, 657, 422, 463, 444, 448, 122, 123, 114; 162/206, 207

(56) References Cited

U.S. PATENT DOCUMENTS

| | | | | |
|---|---|---|---|---|
| 4,154,004 | | 5/1979 | Trötscher | 34/52 |
| 4,253,246 | | 3/1981 | Marchal | 34/121 |
| 5,471,766 | | 12/1995 | Heikkilä et al. | 34/461 |
| 6,014,818 | * | 1/2000 | Kristrom | 34/273 |

* cited by examiner

*Primary Examiner*—Pamela Wilson
(74) *Attorney, Agent, or Firm*—Nixon & Vanderhye P.C.

(57) ABSTRACT

A method and apparatus achieve a more sustainable lift of a wet or heavy pulp web from a pulp machine to the topmost drying level of a pulp drying, allowing the speed of production to be increased and runnability problems to be minimized. The pulp web is lifted from the last press of the pulp machine to the topmost of the drying levels of the pulp dryer by supporting the web on a support wire. The pulp may be passed through the topmost drying level, and one or two other levels, also supported by a support wire, but in subsequent levels the pulp web is preferably supported only by an air cushion. In each level drying gas is blown toward the pulp web (preferably from both above and below the web) to effect drying, and the web passes around turning rolls between each drying level to enter the next, lower, drying level. The support wire may be of metal or plastic, and has a texture significantly coarser than the texture of wires commonly used in pulp machines.

24 Claims, 5 Drawing Sheets

METHOD AND APPARATUS FOR HANDLING AND DRYING A PULP WEB

BACKGROUND AND SUMMARY OF THE INVENTION

The object of the present invention is a method and device used in pulp web drying, as defined in the preambles to the independent claims presented below.

This means that the object of the present invention concerns especially a method and device used in drying a pulp web in a pulp dryer, comprising at least two, or typically several drying levels arranged on top of each other, which drying levels consist of two rows of blow boxes with their nozzle surfaces facing each other, between which a drying gap is formed. From the blow boxes drying air or the like is blown onto the pulp web passing through the drying gap. The passage of the pulp web from one drying level to another is guided by means of turning rolls. In this type of dryer, the wet pulp web is first carried to the topmost drying level of the pulp dryer, and from there on as a winding web through the other drying levels of the pulp dryer, after which the dried pulp web is carried out of the pulp dryer.

Air drying has become established as a common method for drying the pulp web after the press section. In the air dryer the pulp web or web passes in a winding manner through levels that are arranged one on top of the other, from the upper part of the dryer to its lower part. On each level, the web passes horizontally from one end of the dryer to the other, supported on an air-cushion formed by the air blown from the nozzles, without contact with the nozzles, and is turned at the end by the turning rolls to the next drying level. The length of one drying level may be 20–50 m, typically 35–40 m, and the number of levels may be 10–30, typically 18–26. Thus the drying distance on the largest machines is well over 1 km.

The pulp web is transferred from the press section to the dryer by an open draw, that is, without being supported. The pulp dryer, which is structurally higher than the other parts of the wet end, usually has to be installed on a level lower than the machine level of the wet end, on the so-called basement level, from where the dryer rises to machine level and from there several meters, for example 7 m, above machine level. The last press of the press section from which the wet pulp web is lifted to the upper part of the dryer, is usually located only about 2 m above machine level, which means that the wet web has to be lifted by an open draw some 5 m in order to bring the web to the first drying level in the upper part of the pulp dryer.

Pulp production lines are under continuous pressure to increase production and improve efficiency. This leads to an increase in the speed of the machines and in grammages of the pulp web, which in turn results in increasingly heavy pulp webs having to be lifted from the press section to the topmost drying level. The dry weight of the pulp web on pulp dryers falls generally within the range of 550–1200 g/m$^2$. A heavy, wet pulp web may easily break when lifted, and the heavier the pulp is and/or the higher the web has to be lifted, the greater the problems. Difficulties due to heavy grammages may already appear when the dry weight exceeds 900 g/m$^2$. On the other hand, lifting the web to a height exceeding 5 meters may in itself be difficult, irrespective of the grammage.

If the web is wet and heavy, tail threading in particular will be difficult, that is, it is difficult to thread the end of the pulp web undamaged into the dryer. Successful threading is, however, important from the point of view of the efficiency of the production line, to ensure rapid start-up. As pulp web grammages increase, the air blown should be able to carry and transfer increasingly heavy webs at increasing speeds in the dryer itself, which might be difficult, especially on the uppermost drying level through which the pulp web passes when it is at its wettest, that is, at its heaviest.

Another general trend in paper and pulp production is that an increasing number of new, exotic chemical pulps are being tried out and introduced into production. Some of these new pulps are considerably more difficult to dewater on the wire section than. conventional pulps, which means that the pulp will then come from the press section to the air dryer in a wetter state, that is heavier, than normal, thus causing problems. These short-fibred pulps are often also weak in other ways too, and threading them through the dryer may be extremely difficult. In such cases web breaks usually take place immediately on the topmost drying level of the dryer.

Runnability problems in the air dryer due to an excessively heavy web arise even if the actual dry weight of the web is within the correct range, if the web comes to the dryer wetter than expected, that is heavier than expected, due to the operation of the wet end of the pulp machine not being quite in order. In such a case, problems may arise even with familiar long-fibred pulps. Problems may, therefore, arise due to the malfunctioning of the wet end, but only appear as actual breaking problems on the topmost drying level of the pulp dryer. Roughly speaking, it can be said that the situation becomes more difficult if the dry matter content of the web remains below 46%. Apart from the web then being clearly heavier than it would be if its dry matter content was, for example 50%, the wetter the pulp is, the poorer the wet strength of the web.

Variations in dry matter content may also be due to the different dewatering properties of the pulps used. Different pulp types have, among other things, different dewatering properties on the wire section, which is why the dry matter content and thus also the wet strength before the dryer varies by type of pulp.

Problems due to an excessively wet or heavy web generally arise on the topmost level of the dryer, where the air-cushion blown by the blow nozzles under the web is no longer able to carry the heavier web and the web begins to drag along the nozzles, which sooner or later results in a web break. Then knots of fibre become detached from the web—from the layer of the web that has dried first—and these knots are then rolled into so-called cigars, or dust will form, both of which will sooner or later cause a web break and other problems which will result in a fall in production. When the web breaks, the "cigars" and other pulp stock, especially the pulp stock at the wet end of the dryer, easily get caught between the blow boxes, thus making it more difficult to clean the dryer. The risk of these web breaks is greatest on the topmost levels of the pulp dryer.

It is in fact the aim of the present invention to present an improved method and device for pulp web drying, in which particularly the above-mentioned problems have been minimised.

The aim of the invention is thus particularly to achieve a more sustainable lift of a wet or heavy pulp web than before—also in connection with tail threading—from the press to the pulp dryer.

A further aim of the invention is to improve the passage of a particularly wet or heavy pulp web in the first part of the pulp dryer.

For achieving the above aims, the method and device relating to the invention are characterised by what is defined in the characterising parts of the independent claims.

In a pulp dryer, the device relating to the invention comprises a support wire or the like which supports the passage of the pulp web to the pulp dryer, at least to the start of its topmost drying level or the immediate vicinity of the start, but which may also be arranged to support the passage of the pulp web through the first part of the pulp dryer, typically only through the first, or topmost, drying level. If necessary, it is obviously possible to arrange additional support wires on the pulp dryer, which also support the passage of the pulp web through the second and third drying levels. The support wire acting as the leading wire of the pulp web may be very coarse, typically much coarser than the wet end wire used in pulp machines. The support wire can be made of conventional wire materials, either in metal or with a plastic base. The choice of material is affected, for example, by the temperature of the drying process used at any given time.

A typical pulp dryer comprises at least two, or usually a considerable number, such as 10–30, drying levels arranged on top of each other and running from one end of the pulp dryer to the other, looking in the direction of travel of the web. The wet pulp web is carried to the topmost drying level, from where it will pass on in a winding manner through the dryer, one drying level after another, down to the lower part of the dryer. The pulp web is guided by means of the turning rolls at each end of the dryer from one drying level to another, that is, to the next, lower drying level.

The drying levels consist of two rows of blow boxes or the like with their nozzle surfaces facing each other. The space between the rows of blow boxes forms the pulp web drying gap, in which hot drying air or other similar hot gas is blown from the blow boxes onto the pulp web, in order to dry the pulp web as it passes through the drying gap. The length of the drying levels is usually 20–40 meters, typically 35–40 meters, which means that each drying level is fitted with some 130–160 blow boxes, half of which are top nozzles and half bottom nozzles.

Various types of blow boxes known as such can be used in pulp dryers for drying the pulp web and for its non-contacting support through the pulp dryer. Below the pulp web, nozzles are normally used, through which nozzles at least some of the air is discharged as jets parallel to the bearing surface of the blow boxes. The purpose of these air jets parallel to the plane of the pulp web is mainly to stabilise the non-contacting passage of the pulp web through the drying level. Above the pulp web, on the other hand, so-called impingement nozzles are normally used, from which nozzles air is discharged mainly in blows directed perpendicularly towards the pulp web. From the point of view of drying, the perpendicular air jets are the most important. In the dryer, the type of blow boxes disclosed in the American patent U.S. Pat. No. 5,471,766 can, for example, advantageously be used.

In the solution relating to this invention in which the support wire is arranged to support the passage of the pulp web also through the first drying level, the blow boxes of the above type that are located below the support wire, can be replaced by impingement boxes, that is, by means of boxes from which hot air is discharged mainly perpendicularly towards the pulp web. When the pulp web is supported and carried by the support wire, air blows parallel to the plane, which stabilise the web, are not needed, and neither would these blows facilitate drying because they would remain mainly below the support wire and would not, therefore, come into contact with the pulp web to be dried. The entire amount of air can be directed through the support wire, perpendicularly to the pulp web in order to maximise the drying effect of the air.

When the support wire supports the pulp web, the blow from above the support wire can be intensified in comparison to what is conventional without endangering the passage of the pulp web. This will compensate for the fact that the support wire has the effect of weakening the flow coming from below the support wire, that is, the effect of impairing the drying of the bottom surface of the pulp web. On the other hand, intensifying the blowing of the hot air flow from above enhances the drying of the top surface of the pulp web considerably, which facilitates the passage of the web on the next drying level, where this intensively dried top side of the web is in turn the supporting underside. The intensively dried underside is considerably less liable to adhere to the bearing surface of the blow boxes than a wet surface from which fibres detach easily, forming dust and the above-mentioned "cigars".

Sometimes at least some of the blow boxes below the support wire can be replaced by means that support the support wire mechanically, such as sliding surfaces or rollers.

Furthermore, a support wire passing through the first drying level prevents pulp stock from penetrating between the blow boxes below the support wire in the event of a web brake. The support wire conveys the stock formed during the break to the other end of the pulp dryer, out of reach of the blow boxes, from where it may fall down freely.

The advantages achieved by means of the invention include the following:

- The support wire supports the pulp web in the free space between the press and the dryer, supporting the tail threading carried out by a normal tail threading means. In tail threading, the support wire guides the pulp web, which broadens out in width from a narrow band having the width of the leader threading cord to the full width of the web, safely through the "crisis area", that is, the rise and, if necessary, the first drying level. Having passed the crisis area, the web has dried and is stronger and can proceed on its own.
- The support wire makes possible the passage of webs which are heavier/wetter than usual through "crisis areas", that is, the rise to the upper part of the dryer and, if necessary, through the first drying level.
- The support wire then also makes possible the use of higher and steeper rises from the press to the upper part of the pulp dryer.

A support wire extending to the first drying level of the pulp dryer makes possible the use of even more efficient blow boxes in the dryer.

The use of the support wire also makes it possible to achieve more efficient drying above the web, on the first drying level, which facilitates the passage of the pulp web on the drying levels to follow and reduces the formation of "cigars".

The support wire prevents pulp stock from being caught between the blow boxes and thus reduces cleaning time and expenses.

The support wire makes production possible even if the dewatering of the wet end of the pulp machine does not correspond to conventional dewatering due to a technical structural solution or, for example, variation in pulp quality.

BRIEF DESCRIPTION OF THE DRAWINGS

The invention is described in further detail in the following, with reference to the appended drawings in which.

DETAILED DESCRIPTION OF THE DRAWINGS

Figure 1:
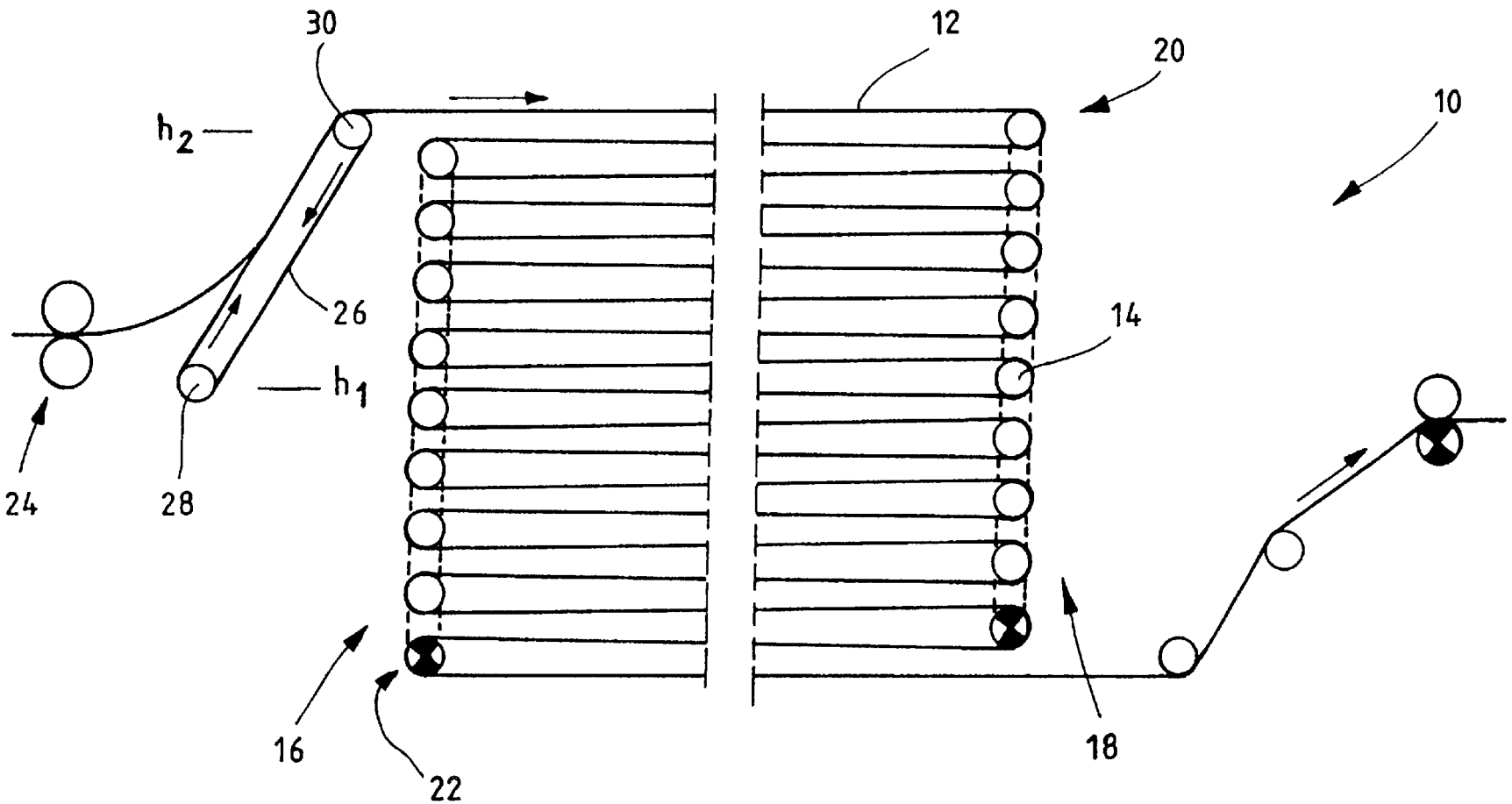
FIG. 1 shows, as a diagrammatic cross-section, the transfer of the pulp web through the pulp dryer, to which pulp dryer is connected the support wire relating to the invention, in order to lift the web to the upper part of the pulp dryer.

FIG. 1 shows a part of a pulp dryer 10, through which the pulp web 12 is guided, by means of turning rolls 14, to pass in a winding manner back and forth from one end 16 of the dryer to the other end 18 and from the first, topmost drying level 20 via the last and lowest drying level 22, out of the dryer.

The wet pulp web 12 to be dried comes from the last press 24 on the press section of the pulp machine to the pulp dryer. The press 24 is at a considerably lower level $h_1$ than the level $h_2$ of the first, that is the topmost, drying level 20, to which level the pulp web is to be lifted.

The pulp web is lifted by means of the support wire 26 relating to the invention, which is mainly of the same width as the pulp web, and which is arranged to pass in a loop between the press 24 and the upper part of the pulp dryer, guided by means of two turning rolls 28, 30. The lower turning roll 28 is fitted mainly at the level $h_1$ of the press 24, and the upper turning roll 30 at the level $h_2$ of the of the first drying level 20 of the pulp dryer.

Figure 2:
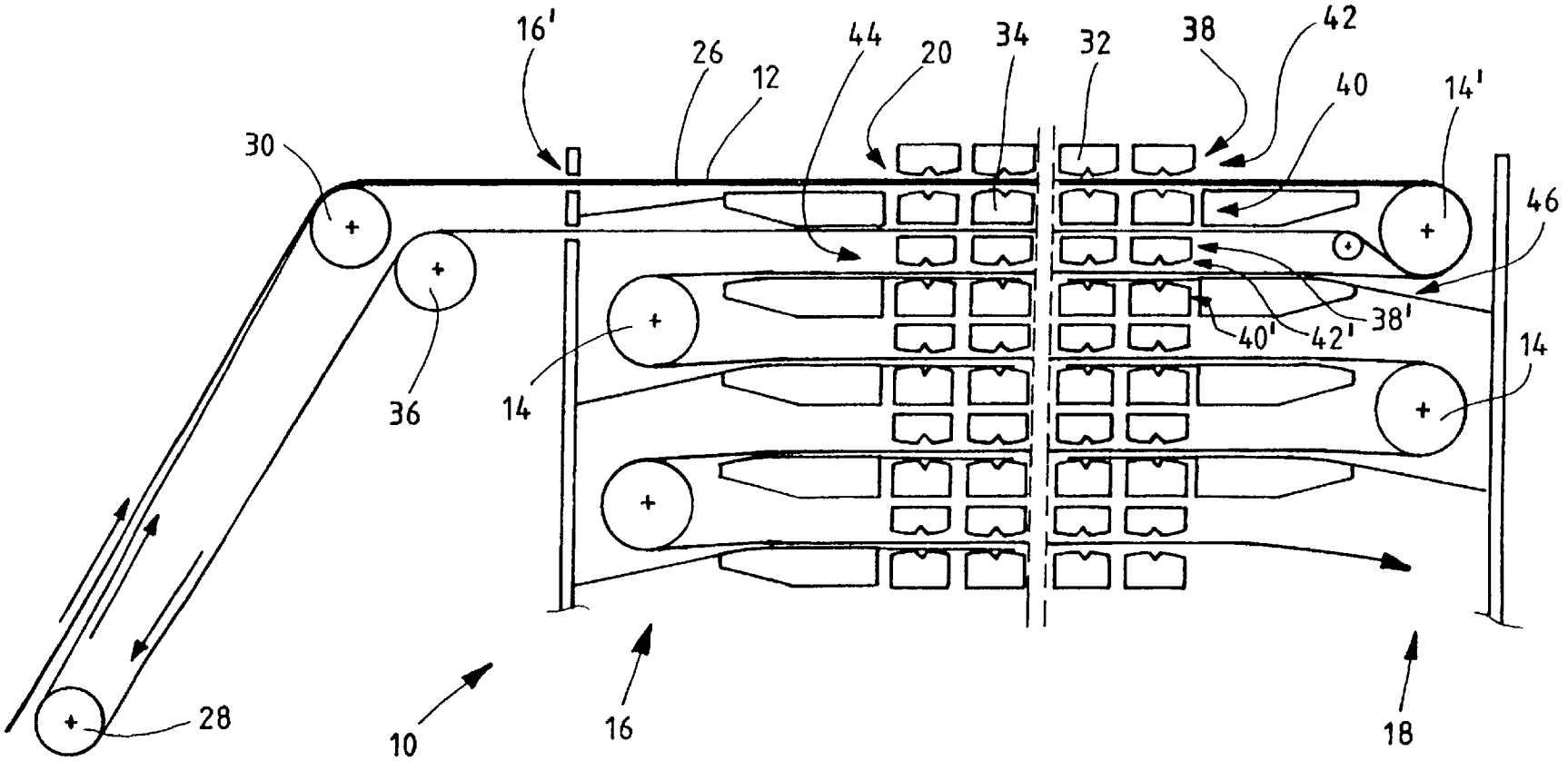
FIG. 2 shows, as a diagrammatic cross-section, a part of a pulp dryer with its blow boxes, to which pulp dryer is connected the support wire relating to the invention, in order to lift the web to the upper part of the pulp dryer and to guide it through the first drying level.

FIG. 2 shows a part of the pulp dryer 10 with its turning rolls 14 and blow boxes 32, 34. In the case of FIG. 2, a support wire solution relating to the invention is connected to the pulp dryer, in which the support wire 26 is arranged to pass from the press to the upper part of the pulp dryer 10 guided by the turning rolls 28, 30, and from there on through the first drying level 20, from one end 16 of the pulp dryer to the other end 18. The turning roll 14' at the end 18 of the drying level guides the support wire 26 to turn back to the beginning 16 of the drying level, where the guide roll 36 turns the support wire down towards the first turning roll 28.

On the first drying level 20, between the row of blow boxes 38, consisting of the upper blow boxes 32, and the row of blow boxes 40, consisting of the lower blow boxes 34, a drying gap 42 is formed, through which the support wire 26 is arranged to pass from the beginning 16 to the end 18 of the pulp dryer. The support wire 26 thus supports the pulp web 12. The support wire is arranged to pass from the end 18 of the first drying level 20, between the first drying level and the second drying level 44 back to the beginning 16 of the drying levels. The pulp web, on the other hand, is arranged to pass through the drying gap 42' formed between the row of blow boxes 38' formed by the upper blow boxes 44 of the second drying level and the row of blow boxes 40' formed by the lower blow boxes.

In the pulp dryer shown in FIG. 2, the pulp web 12 passes from the last press, supported by the support wire 26, from the level of turning roll 28 to the level of turning roll 30, from where the web 12 continues, supported by the support wire 26, from the entry 16' of the pulp dryer to the first drying level 20 and through the drying gap 42 to the end 18 of the pulp dryer. The pulp web thus passes, supported by the support wire, from the beginning 16 of the drying level to its end 18.

After the turning roll 14, the pulp web 12 is detached from the support wire 26 and is guided, in the case of FIG. 2, on the guide surface 46 to the drying gap 42' of the second drying level 44, in which gap the blows of the blow boxes 38', 40' support and/or dry the web as it passes forward, that is, back to the beginning 16 of the pulp dryer, but one level lower than the entry 16' of the pulp web. The support wire 26 returns between the drying levels 20, 44 to the beginning of the pulp dryer and from there, via the guide roll 36, to the turning roll 28. In FIG. 2, all blow boxes have been depicted as identical even though they may be of different types.

Figure 3:
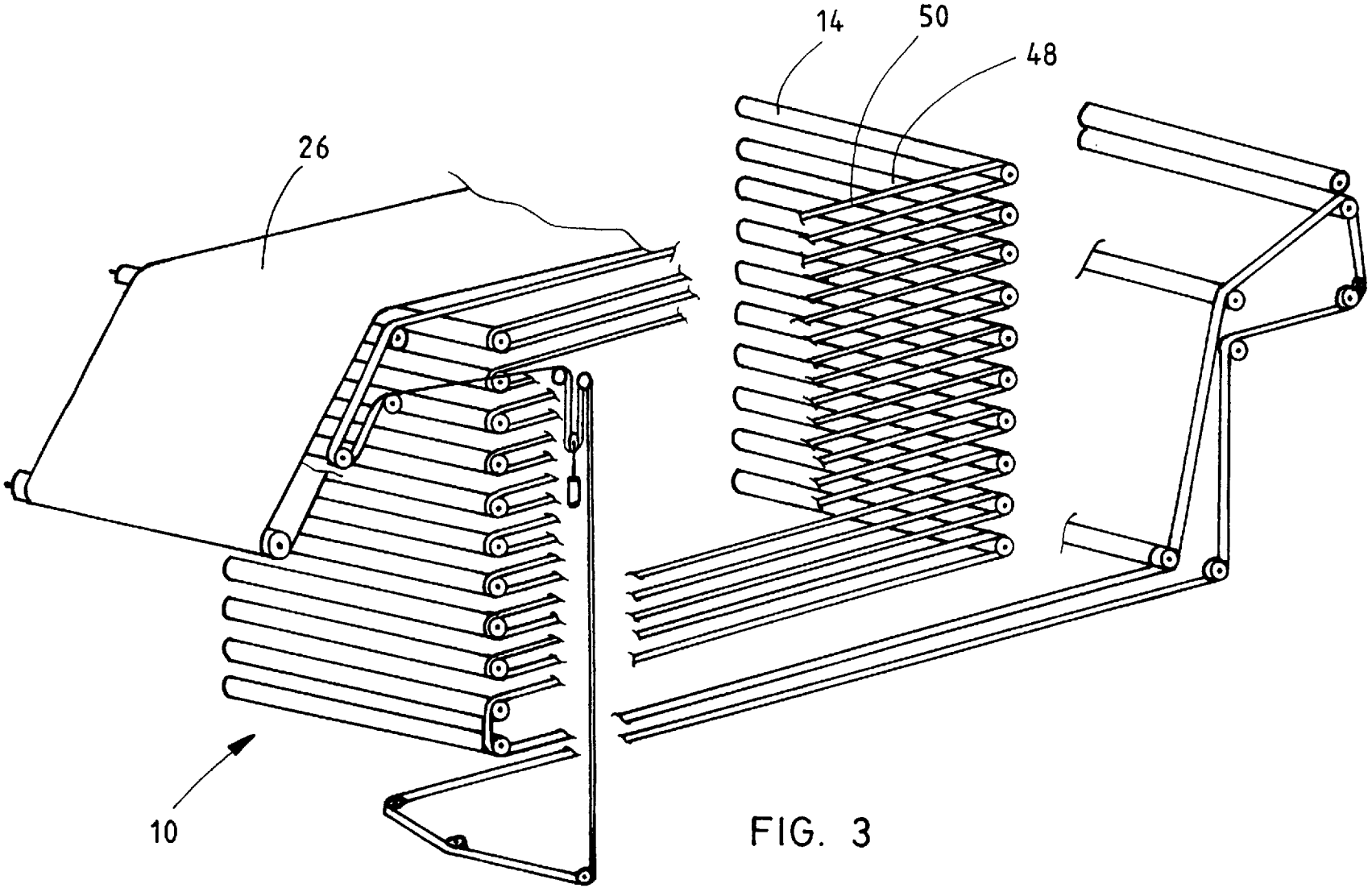
FIG. 3 shows a diagrammatic and partly opened axonometric view of a part of a pulp dryer with its turning rolls and tail threading means, to which pulp dryer is connected a support wire relating to the invention.

FIG. 3 shows a part of the pulp dryer 10 with its turning rolls 14 and tail threading means 48, as well as the support wire solution relating to FIG. 2. The turning rolls of the tail threading cord or leader threading cord 50 of the tail threading means are fitted on the shaft extensions of the turning rolls 14 of the pulp web so that the tail threading cord will run parallel to the direction of travel of the pulp web. In this case the support wire 26 and the tail threading cord also run parallel on the first drying level. In connection with the start-up of the machine, the part which spreads beyond the tail threading cord as the pulp web or the leader broadens, is transferred onto the support wire which supports the passage of the pulp web before the pulp dryer and on its first drying level, which means that the pulp web can be transferred safely across critical areas to the second drying level.

Figure 4:
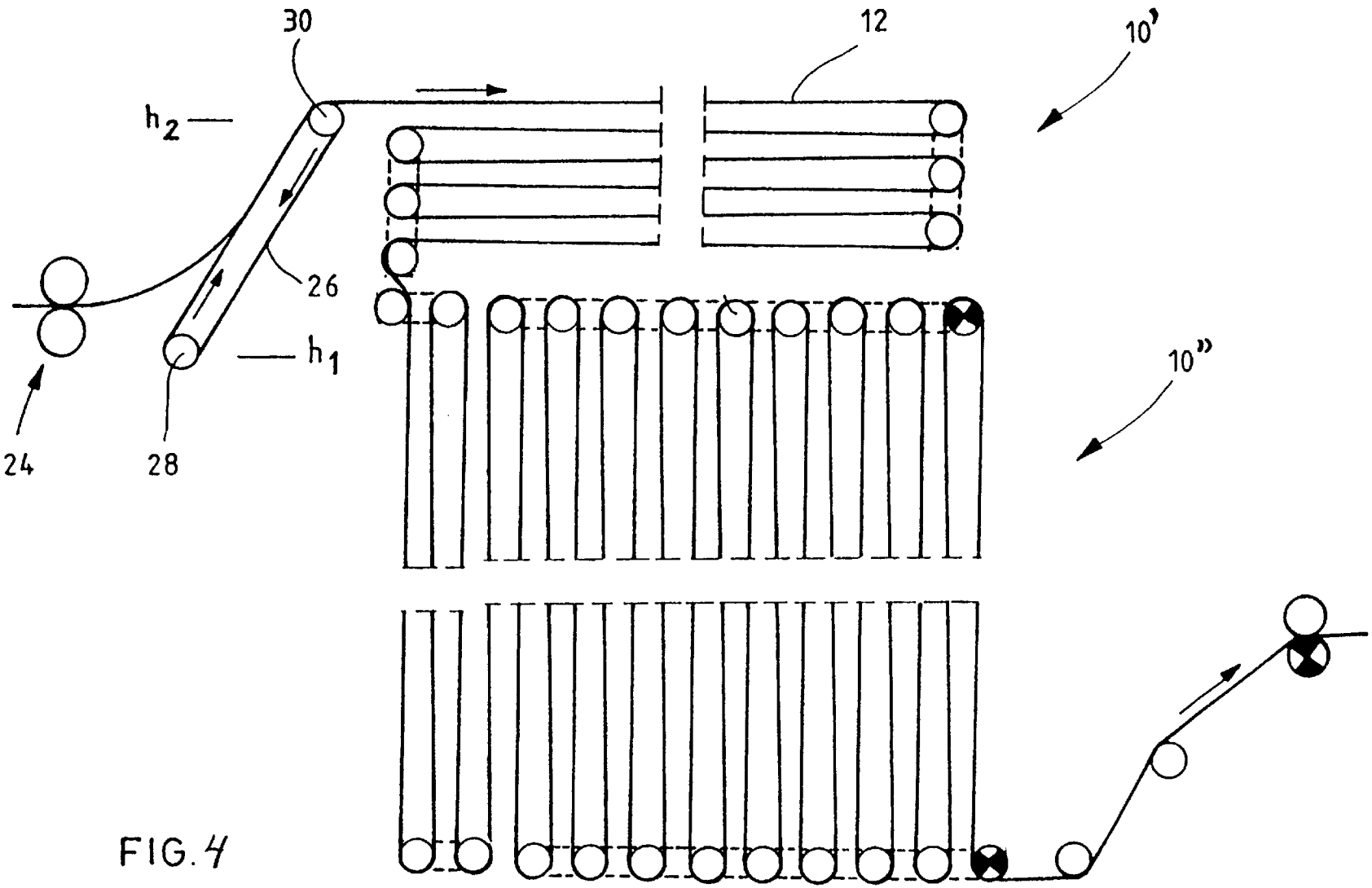
FIG. 4 shows a diagrammatic cross-section, in accordance with FIG. 1, of another pulp dryer relating to the invention.

The solution relating to the invention is applicable to various types of pulp dryer solution such as the two-part pulp dryer shown in FIG. 4, which consists of the upper part 10' of the pulp dryer comprising horizontal drying gaps, and a lower part 10" of the pulp dryer comprising vertical drying gaps, and in which the drying of the pulp web in the horizontal and vertical drying gaps is combined. In the solution shown in FIG. 4, the pulp web 12 is transferred to the upper part 10' of the pulp dryer, supported by the support wire 26 in accordance with the invention, from where the pulp web is first guided as a winding web downwards through the horizontal drying gaps in the upper part 10' of the pulp dryer, and thereafter through the vertical drying gaps in the lower part 10" of the pulp dryer.

The upper part 10' of the pulp dryer and the horizontal drying gaps in it are dimensioned to be such that the strength of the pulp web in the upper part 10' increases sufficiently to be able to withstand the vertical web transfer in the lower part 10".

Figure 5:
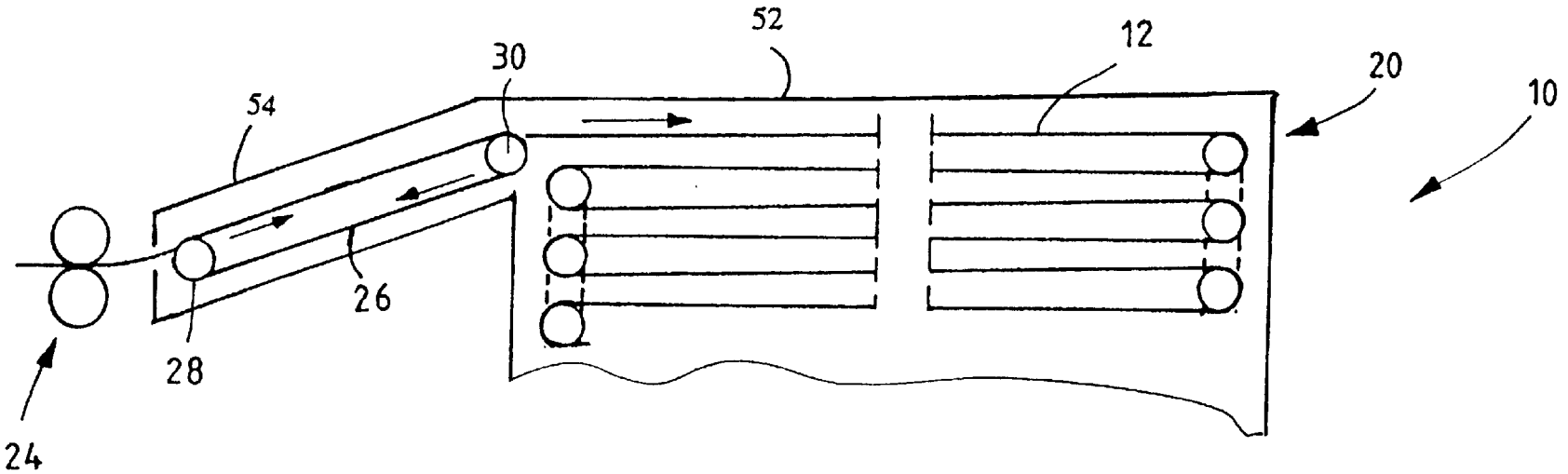
FIG. 5 shows a diagrammatic cross-section, in accordance with FIG. 1, of the upper part of a pulp dryer relating to the invention and the hood enclosing it.

As shown in FIG. 5, the pulp dryer 10 is typically covered by a hood 52, which prevents the humid, hot air formed in drying from mixing with the air in the machine room. If desired, the support wire 26 relating to the invention may also be covered completely or partly with a hood. The support wire construction of the pulp dryer shown in FIG. 5 is covered completely by a hood 54. The hood 54 reduces cooling of the pulp web and support wire in this area. This prevents heat losses which take place when heat is transferred from the hot pulp web to the surrounding air and to the cold support wire, and from there further to the surrounding air. The hood also prevents the transfer of heat through the support wire from the topmost drying gaps to the surrounding air.

By enclosing the support wire, especially its underside, not only heat losses through the support wire can be prevented, but also the condensation of humidity on the wire and/or the flow of condensed water down to machine level. By means of a hood construction on the underside of the support wire 26, the water flowing from the support wire can easily be collected and thus prevented from dripping into the machine room.

If desired, in addition to or instead of the hood 54, hot air blowing can be arranged on the support wire or the pulp web supported by the support wire, to keep the support wire and/or pulp web warm.

Figure 6:
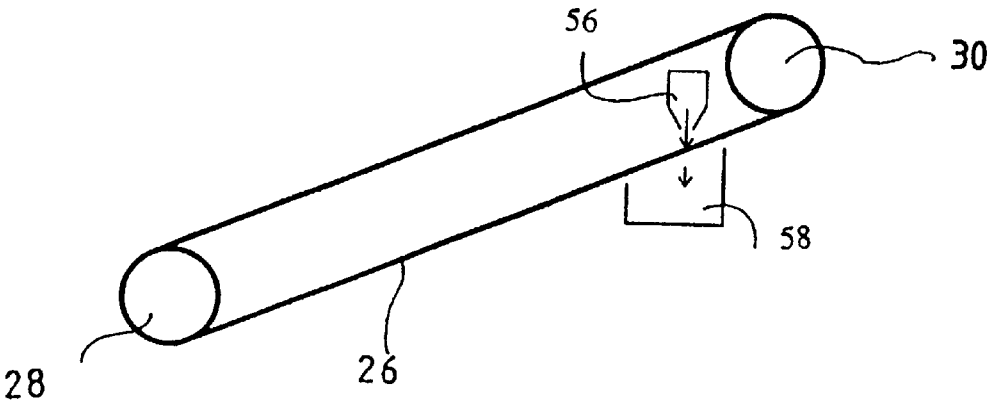
FIG. 6 shows a diagrammatic cross-section of the support wire system relating to the invention.

The support wire 26 can easily be kept dry even with relatively limited air blowing, as shown in FIG. 6. In such a case, means 56 are fitted inside the loop formed by the support wire 26 for blowing air, preferably hot air, through the return loop of the support wire, in order to remove humidity from the wire. Since the support wire is typically fairly coarse, a relatively low air velocity is required for the blowing. The blowing can be carried out, for example, by means of a medium-pressure or low-pressure blower, with an air velocity of e.g. 40 m/s, from a 5 mm slot, in which case the volume flow is $V=0.2\ m^3/s/m$ width, and the total pressure required of the blower is $P_t=1200$ Pa. Below the support wire means 58 are fitted for collecting draining water.

The aim is not to limit the invention to the foregoing embodiments, but on the contrary to apply it broadly within the scope of protection of the appended claims.

What is claimed is:

1. A method of drying a wet pulp web from a press section, using a pulp dryer having at least two drying levels one atop the other, and at least the topmost drying level above the press section, each drying level having rows of nozzles facing each other, and the dryer also including devices which guide the passage of the pulp web from one drying level to another, said method comprising:

a) lifting the pulp web from the press section into operative association with the topmost of the wet drying levels by supporting the pulp web on a support wire;

b) passing the pulp web through the drying levels in sequence; and c) blowing drying gas through the nozzles toward the pulp web to effect drying thereof while passing through the drying levels.

2. A method as recited in claim 1 further comprising detaching the pulp web from the support wire in a) substantially upon entry of the pulp web into the topmost drying level.

3. A method as recited in claim 1 wherein a) is further practiced to convey the pulp web through the topmost drying level with the support wire, and wherein said method further comprises detaching the pulp web from the support wire after passage through the topmost drying level.

4. A method as recited in claim 1 wherein the dryer has more than three drying levels; wherein a) and b) are practiced to convey the pulp web supported by a support wire through only between two and three of the topmost drying levels of the dryer; and wherein b) is practiced by passing the pulp web through the drying levels below the two or three topmost drying levels supported by an air cushion.

5. A method as recited in claim 4 wherein a) and b) are practiced to convey the pulp web supported by a support wire through only the two topmost drying levels.

6. A method as recited in claim 1 further comprising, after a break of the pulp web, tail threading the pulp web into the pulp dryer.

7. A method as recited in claim 1 wherein b) is practiced in part by bringing the pulp web into contact with turning rolls positioned between the drying levels so that the pulp web moves in opposite directions in adjacent drying levels.

8. A method as recited in claim 1 wherein a) is practiced to lift the pulp web from the last press of a pulp machine to the topmost of the drying levels.

9. A method as recited in claim 1 wherein c) is practiced by blowing drying gas onto the pulp web from nozzles in blow boxes positioned above and below the pulp web, and wherein a)–c) are practiced using a pulp web having a dry weight of over 900 $g/m^2$, and wherein a) is practiced to lift the web more than five meters.

10. A pulp web handling assembly, comprising:

a press section at a first vertical level;

a pulp dryer comprising at least two pulp drying levels one atop the other, and at least the topmost level above the first vertical level;

devices which guide the passage of the pulp web from one drying level to another;

a plurality of nozzles in each drying level disposed in rows of nozzles facing each other and directed toward the pulp web passing therebetween; and a support wire which lifts the pulp web from said press section into operative association with the topmost of said pulp drying levels.

11. An assembly as recited in claim 10 wherein said devices which guide the pulp web between drying levels comprise turning rolls, and wherein the topmost drying level is more than five meters above said press section.

12. An assembly as recited in claim 10 further comprising, associated with said support wire, a first turning roll in the vicinity of the last press of a pulp machine, and a second turning roll positioned at an entry to said topmost drying level, said support wire passing over said first and second turning rolls.

13. An assembly as recited in claim 12 further comprising, associated with said support wire, a third turning roll in the vicinity of an outlet from said topmost drying level, said support wire extending through said topmost drying level and passing around said third turning roll, so as to convey the pulp web through said topmost drying level.

14. An assembly as recited in claim 13 wherein at least a plurality of said nozzles in said topmost drying level are positioned below the pulp web and are components of impingement blow boxes which blow heated gas through said support wire substantially perpendicular thereto to the pulp web to effect drying thereof.

15. An assembly as recited in claim 13 further comprising means for supporting the passage of said support wire through said topmost drying level, said means disposed below said support wire in said topmost drying level.

16. An assembly as recited in claim 10 wherein each drying level has a length of about 35–40 m.

17. An assembly as recited in claim 16 wherein said at least two drying levels comprises between 10–30 drying levels, one atop the other.

18. An assembly as recited in claim 17 wherein said plurality of nozzles in each drying level are components of blow boxes; and wherein each drying level comprises between about 130–160 blow boxes, approximately half disposed above the pulp web, and approximately half disposed therebelow.

19. An assembly as recited in claim 10 wherein said at least two drying levels comprises between 18–26 drying levels, one atop the other.

20. An assembly as recited in claim 10 wherein said plurality of nozzles in each drying level are components of blow boxes; and wherein each drying level comprises between about 130–160 blow boxes, approximately half disposed above the pulp web, and approximately half disposed therebelow.

21. An assembly as recited in claim 10 wherein said support wire is made of metal or a plastic-based material, and has approximately the same width as the pulp web.

22. An assembly as recited in claim 21 wherein said support wire has a texture significantly coarser than the texture of wires commonly used in pulp machines.

23. An assembly as recited in claim 10 further comprising pulp web tail threading means for threading the pulp web through said pulp dryer after a web break.

24. An assembly as recited in claim 10 wherein said support wire passes through said topmost drying level; and further comprising means for supporting the passage of said support wire through said topmost drying level, said means disposed below said support wire in said topmost drying level, and wherein the pulp web is unsupported by a support wire throughout a plurality of said drying levels.

* * * * *